US005927378A

United States Patent [19]

Grove et al.

[11] Patent Number: 5,927,378

[45] Date of Patent: Jul. 27, 1999

[54] CONTINUOUS CASTING MOLD AND METHOD

[75] Inventors: John A. Grove, Franklin; James B. Sears, Jr., Cranberry Township, both of Pa.

[73] Assignee: AG Industries, Inc., Coraopolis, Pa.

[21] Appl. No.: 08/822,559

[22] Filed: Mar. 19, 1997

[51] Int. Cl.[6] ..... B22D 11/124

[52] U.S. Cl. ..... 164/485; 164/443

[58] Field of Search ..... 164/443, 485, 164/348

[56] References Cited

U.S. PATENT DOCUMENTS

| | | | |
|---|---|---|---|
| 2,169,893 | 8/1939 | Crampton et al. . | |
| 2,862,265 | 12/1958 | Vaughn et al. . | |
| 2,893,080 | 7/1959 | Goss . | |
| 3,511,305 | 5/1970 | Wertli . | |
| 3,528,487 | 9/1970 | Wognum et al. . | |
| 3,763,920 | 10/1973 | Auman et al. . | |
| 3,978,910 | 9/1976 | Gladwin . | |
| 4,182,397 | 1/1980 | Schmucker et al. | 164/443 |
| 4,464,209 | 8/1984 | Taira et al. | 148/36 |
| 4,535,832 | 8/1985 | Sevastakis | 164/421 |
| 4,640,337 | 2/1987 | Sevastakis | 164/443 |
| 5,117,895 | 6/1992 | Hargassner et al. | 164/443 |
| 5,201,909 | 4/1993 | Von Wyl et al. | 164/418 |
| 5,207,266 | 5/1993 | Nakashima et al. | 164/348 |
| 5,467,810 | 11/1995 | Grove | 164/443 |

FOREIGN PATENT DOCUMENTS

| | | | |
|---|---|---|---|
| 51-8124 | 1/1976 | Japan . | |
| 53-66817 | 6/1978 | Japan . | |
| 558-9167 | 1/1983 | Japan . | |
| 59-133940 | 8/1984 | Japan | 164/443 |
| 60-250856 | 12/1985 | Japan . | |
| 61-195746 | 8/1986 | Japan | 164/443 |
| 61-235516 | 10/1986 | Japan . | |
| 63-47337 | 2/1988 | Japan . | |
| 3-35850 | 2/1991 | Japan . | |
| 3-42144 | 2/1991 | Japan . | |
| 952422 | 8/1982 | U.S.S.R. . | |
| 248912 | 8/1986 | U.S.S.R. . | |

*Primary Examiner*—Kuang Y. Lin
*Attorney, Agent, or Firm*—Knoble & Yoshida LLC

[57] ABSTRACT

An improved mold assembly for a continuous casting machine includes a mold liner assembly having an inner surface defining a casting space in which molten metal is shaped and cooled, an immersion nozzle, terminating within the casting space, for introducing molten metal into the casting space, and selective cooling structure for selectively cooling the mold liner assembly in such a manner that cooling is directed in varying intensities to different portions of the inner surface of the mold liner assembly according to predetermined circulation patterns in the molten metal, whereby heat transfer inequality as a result of convection is accommodated over the entire inner surface of the mold liner assembly.

15 Claims, 4 Drawing Sheets

CONTINUOUS CASTING MOLD AND METHOD

BACKGROUND OF THE INVENTION

1. Field of the Invention

This invention relates broadly to the field of metal production and casting. More specifically, this invention relates to an improved mold for a continuous casting system that has a longer useful life, improves the uniformity of heat removal, and turns out a better product than conventional continuous casting molds do.

2. Description of the Prior Art

A conventional continuous casting mold includes a number of liner plates, usually made of copper, and outer walls surrounding the liner plates. The liner plates define a portion of the mold that contacts the molten metal during the casting process. Parallel vertically extending cooling water circulation slots or passageways are provided between the outer walls and the liner plates to remove heat from the liner plates. During operation, water is introduced to these slots, usually at the bottom end of the mold, from a water supply via an inlet plenum that is in communication with all of the slots in a liner plate. The cooling effect so achieved causes an outer skin of the molten metal to solidify as it passes through the mold. The solidification is then completed after the semi-solidified casting leaves the mold by spraying additional coolant, typically water, directly onto the casting. This method of metal production is highly efficient, and is in wide use in the United States and throughout the world.

In most continuous casting machines the molten metal is introduced into the mold from a tundish through a refractory nozzle that is submerged within the mold. As a result of the constant introduction of molten metal through the nozzle ports, the shape of the mold, and the cooling effect that is applied by the hofface of the mold, hot metal or molten metal circulation currents form within the mold and, through the well documented heat transfer medium of convection, cause the cooling rate to be uneven over the surface of the hofface. This can cause uneven deterioration of the hofface, and contribute to premature mold failure. It can also impact adversely on the quality of the cast product. One example of this may be found in the operation of funnel-type molds. A funnel-type mold is used to cast a thin slab product, and includes, at the introduction end of the mold, a relatively wide central region, relatively narrow end regions, and transition regions between the central region and the end regions. The refractory nozzle is inserted into the central region, and, it has been found in practice, premature wear and failure of the mold tend to occur at the transition regions. One of the reasons for this premature wear is felt to be that the rush of incoming molten metal that exits the outlets of the immersion nozzle cause the adjacent inner surface of the solidifying product to be reheated, preventing additional cooling from occurring as the skin travels through this area and in some extreme cases, causes reheating and remelting of the skin to occur. That causes the skin to be thinner in those areas surrounding the outlet ports, which in turn raises the surface temperature of the product and the surface temperature of the mold liner. To the inventors' knowledge, no workable solution to this problem has yet been proposed.

It is clear that a need exists for an improved continuous casting mold and method of continuous casting that compensates for the destructive effect of hot metal circulation patterns within the continuous casting mold.

SUMMARY OF THE INVENTION

Accordingly, it is an object of the invention to provide an improved continuous casting mold and a method of continuous casting that compensates for the destructive effect of hot metal circulation patterns within the continuous casting mold.

In order to achieve the above and other objects of the invention, an improved mold assembly for a continuous casting machine includes a mold liner assembly having an inner surface defining a casting space in which molten metal is shaped and cooled; an immersion nozzle, terminating within the casting space, for introducing molten metal into the casting space; and selective cooling structure for selectively cooling the mold liner assembly in such a manner that cooling is directed in varying intensities to different portions of the inner surface of the mold liner assembly according to predetermined circulation patterns in the molten metal, whereby heat transfer inequality as a result of convection is accommodated over the inner surface of the mold liner assembly.

According to a second aspect of the invention, a method of operating a continuous casting machine of the type having a mold liner assembly that has an inner surface defining a casting space in which molten metal may be shaped and cooled, includes steps of: (a) introducing molten metal into the casting space; and (b) selectively cooling the mold liner assembly in varying intensities at different portions of the inner surface of the mold liner assembly according to predetermined circulation patterns in the molten metal, whereby heat transfer inequality as a result of convection is accommodated over the inner surface of the mold liner assembly, product quality is enhanced and mold life is lengthened.

These and various other advantages and features of novelty which characterize the invention are pointed out with particularity in the claims annexed hereto and forming a part hereof. However, for a better understanding of the invention, its advantages and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
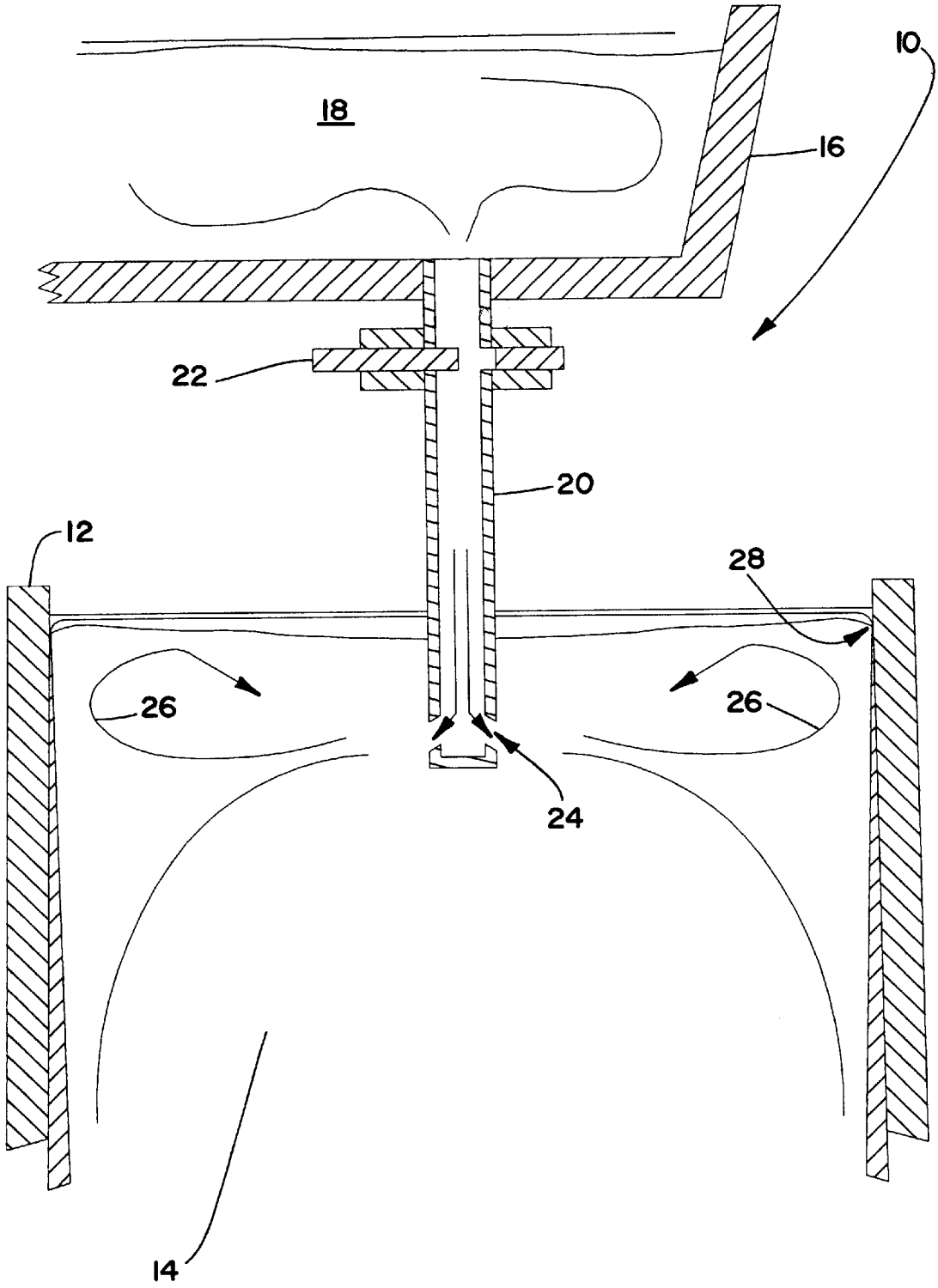
FIG. 1 is a diagrammatical view of a continuous casting machine that is constructed according to a preferred embodiment of the invention.

Referring now to the drawings, wherein like reference numerals designate corresponding structure throughout the views, and referring in particular to FIG. 1, a continuous casting machine 10 that is constructed according to a preferred embodiment of the invention includes a mold assembly 12 that defines a casting space 14 in which molten metal may be shaped and cooled. Mold assembly 12 is preferably a near net shape type, and in the illustrated embodiment is of the funnel type. Continuous casting machine further includes a tundish 16 in which a supply of molten metal 18 is stored, and an immersion nozzle 20 for introducing the molten metal 18 from the tundish 16 into the casting space 14 that is defined by the mold assembly 12. A slide gate 22, as is conventional, is positioned above the immersion nozzle 20 for controlling the flow of molten metal 18 therethrough.

A distal end of immersion nozzle 20 has a number of outlets 24, through which the molten metal 18 is introduced into the casting space 14. As a result of the shape of the mold assembly 12 and the introduction of the molten metal 18 into the casting space 14, circulation patterns 26 are formed in the molten metal that is within the casting space 14, as is graphically depicted in FIG. 1. As is described above, the effects of the circulation patterns 26 contribute to premature mold deterioration and failure, particularly in the meniscus region 28 of the mold assembly 12.

Figure 2:
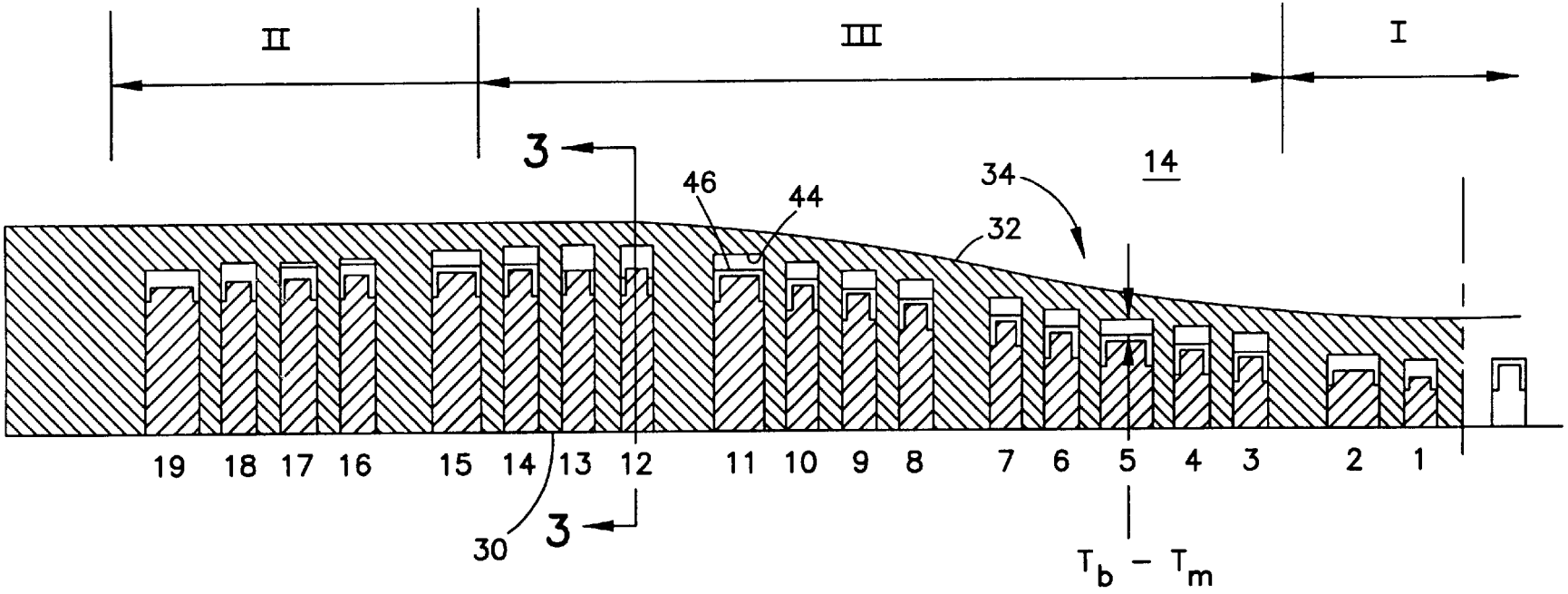
FIG. 2 is a fragmentary cross-sectional view taken through one component of a mold assembly that is constructed according to the invention.
Figure 3:
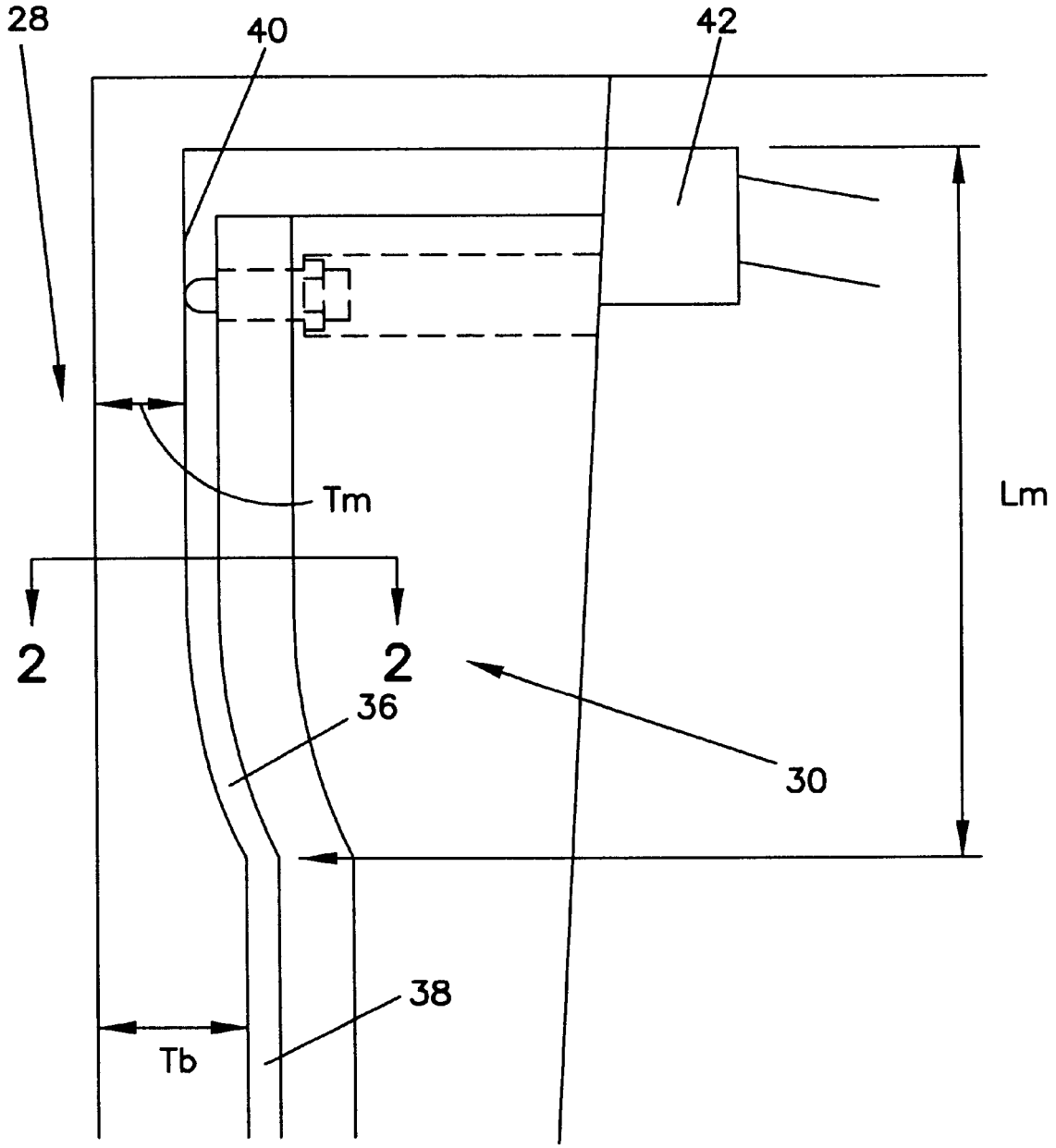
FIG. 3 is a second fragmentary cross-sectional view taken through another component of the system that is depicted in FIGS. 1 and 2.

Referring now to FIGS. 2 and 3, it will be seen that the mold 12 includes a mold liner assembly 30 that includes an inner surface 32 that defines the casting space 14. According to one important aspect of the invention, the mold liner assembly 30 incorporates a selective cooling arrangement 34 for selectively cooling the mold liner assembly 30 in such a manner that cooling is directed in varying intensities to different portions of the inner surface 32 of the mold liner assembly 30 according to the predetermined circulation patterns 26 (shown in FIG. 1) in the molten metal, so that heat transfer inequality as a result of convection is accommodated over the inner surface of the mold liner assembly. As is conventional, the mold liner assembly 30 has a number of cooling slots 36 defined in the mold liner for conducting heat away from the inner surface 32 of the mold liner assembly 30. As may be seen in FIG. 3, the cooling slots 36 according to this embodiment of the invention include a base slot portion 38 that is relatively parallel to the inner surface 32 of the mold liner assembly 30 and is machined to a depth that defines a mold wall thickness $T_b$ that is equal to the distance between the bottom of the base slot portion 38 and the inner surface 32. In the meniscus region 28, as may also be best seen in FIG. 3, the cooling slot 36 includes a deepened slot portion 40 that is machined to be deeper than the base slot portion 38, and defines a minimum thickness $T_m$ between the bottom of slot portion 40 and the inner wall 32 of the mold liner assembly 30. The deepened slot portion 40 communicates with a plenum 42 for conducting water away from the slot 36 during operation, as is well known in this area of technology.

Since the thickness $T_m$ at the deepened slot portion 40 is less than the thickness $T_b$ at the base slot portion 38, an enhanced cooling effect is directed to the area of the mold proximate to the meniscus region 28, the extent of which may be measured by the difference in thickness between the two slot areas, or $T_b$–$T_m$, as is shown diagrammatically in FIG. 2.

FIG. 2 shows the bottom 44 of the slot portion 40 at the meniscus region 28, as well as the slot bottom 46 at the base slot portion 38. As may be seen in FIG. 2, which is a cross section taken horizontally across the mold wall as shown by lines 2—2 in FIG. 3, this distance $T_b$ –$T_m$ is intentionally varied along the horizontal extent of the mold so as to selectively direct enhanced cooling to certain portions of the inner surface of the mold liner assembly, and, to direct a diminished cooling effect to other portions of the mold liner assembly. The mold liner assembly 30 depicted in FIG. 2 is that of a conventionally shaped funnel mold. It includes a first relatively wide central region, which is identified by Roman numeral I, relatively narrow end regions (II), and transition regions (III) between the central regions I and the end regions II. In one embodiment of the invention, enhanced cooling is directed to the inner surface 32 of the mold liner assembly 30 in the transition region III in order to accommodate the increased heat transfer that has been planned to occur at that region as a result of the circulation patterns 26 within the casting space 14. In this embodiment of the invention, the distance $T_b$–$T_m$ is increased. A second aspect of this embodiment of the invention is that decreased cooling is intentionally directed to the relatively wide central region I and the outermost slots in region II, and this is done by decreasing the distance $T_b$–$T_m$.

Figure 4:
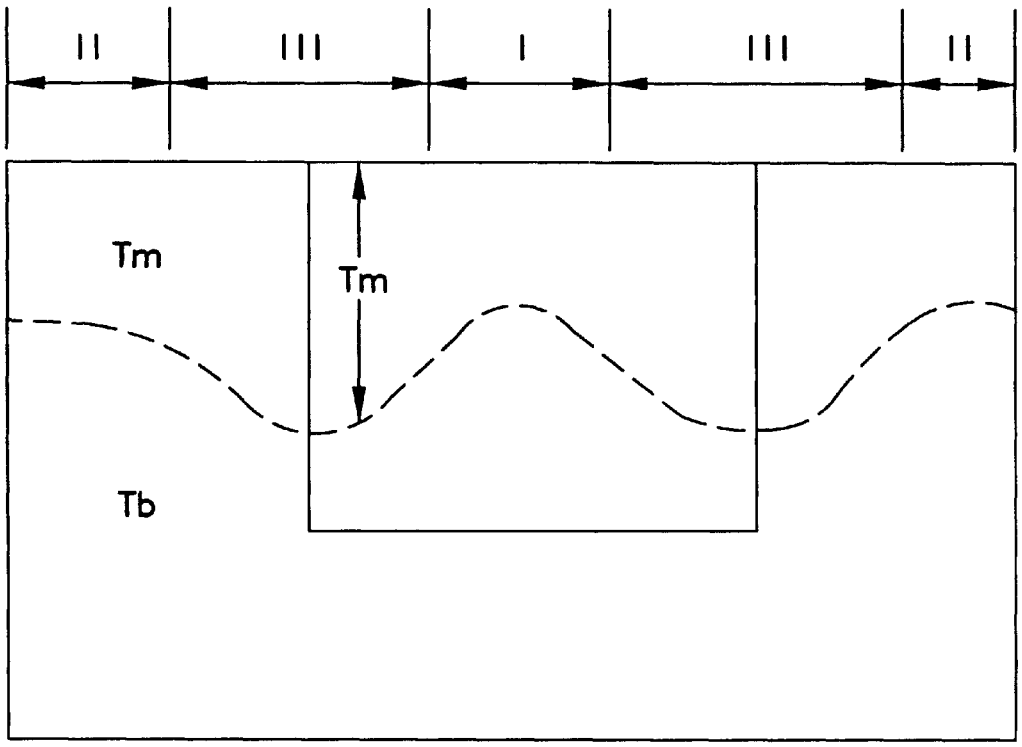
FIG. 4 is a schematic depiction of a length profile of a mold that is constructed according to a preferred embodiment of the invention.

Another aspect of the invention can, in order to direct cooling at the areas of the mold liner that need it the most, be employed together or in lieu of the variable thickness residual $T_b$–$T_m$ discussed above. As is illustrated in FIG. 2, the deepened slot portion 40 that is machined to be deeper than the base slot portion 38 extends for a vertical distance $L_m$. The second aspect of the invention involves varying the length $L_m$ of the individual slots so that the length is greater in those slots where an enhanced cooling effect is desired, which again in the preferred embodiment is mainly in the transition region Ill. FIG. 4 schematically depicts the length profile of the deepened slot portions 40 of the slots.

A preferred example of the construction described above is depicted in FIG. 2, wherein the cooling slots are numbered, beginning from the center of region I and ending at the distal end of region II, as slots 1 through 19. The chart below provides exemplary values of $T_m$, $T_{b[<m]ditl}$ $-Tm$ and $L_m$ for each of slots 1 through 19.

| SLOT | 1 | 2 | 3 | 4 | 5 | 6 | 7 | 8 | 9 | 10 | 11 | 12 | 13 | 14 | 15 | 18 | 17 | 18 | 19 |
|---|---|---|---|---|---|---|---|---|---|---|---|---|---|---|---|---|---|---|---|
| $T_m$ (mm) | 25 | 24 | 23 | 22 | 22 | 21 | 21 | 20 | 20 | 20 | 20 | 20 | 21 | 22 | 22 | 23 | 24 | 25 | 25 |
| $T_b$–$T_m$ | 0 | 1 | 2 | 3 | 3 | 4 | 4 | 5 | 5 | 5 | 5 | 5 | 4 | 3 | 3 | 2 | 1 | 0 | 0 |
| $L_m$ (mm) | 8 | 8 | 8 | 8 | 10 | 12 | 14 | 16 | 18 | 20 | 20 | 18 | 16 | 14 | 12 | 10 | 8 | 8 | 8 |

Alternatively, the length of the slots could be varied without varying the slot depths, or the slot depths could be varied without varying the length of the slots. In addition, the principles of this invention could be applied to other types of continuous casting machines than that shown in the attached drawings.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An improved mold assembly for a continuous casting machine, comprising:

a funnel-type mold liner assembly having an inner surface defining a casting space in which molten metal is shaped and cooled, said mold liner comprising a relatively wide central region, relatively narrow end regions, and transition regions between said central region and said end regions;

an immersion nozzle, terminating within the casting space, for introducing molten metal into the casting space; and selective cooling means for selectively cooling said mold liner assembly in such a manner that cooling is directed in varying intensities to different portions of the inner surface of the mold liner assembly and so as to direct enhanced cooling to said transition regions, whereby heat transfer inequality as a result of convection may be accommodated over the inner surface of the mold liner assembly.

2. An assembly according to claim 1, wherein said selective cooling means is further constructed and arranged to provide enhanced cooling to a meniscus portion of said inner surface of said mold liner assembly.

3. An assembly according to claim 1, wherein said selective cooling means is constructed and arranged to direct cooling at varying intensities by accordingly varying distances between the inner surface of the mold liner assembly and the bottoms of cooling slots that are defined in the mold liner assembly.

4. An assembly according to claim 3, wherein said selective cooling means is further constructed and arranged to direct cooling at varying intensities by accordingly varying the length of deepened slot portions according to the amount of cooling that is desired at a particular area in the mold face.

5. An assembly according to claim 1, wherein said selective cooling means is constructed and arranged to direct cooling at varying intensities by accordingly varying the length of deepened slot portions according to the amount of cooling that is desired at a particular area in the mold face.

6. An improved mold assembly for a continuous casting machine, comprising:

a funnel-type mold liner assembly having an inner surface defining a casting space in which molten metal is shaped and cooled, said mold liner comprising a relatively wide central region, relatively narrow end regions, and transition regions between said central region and said end regions;

an immersion nozzle, terminating within the casting space, for introducing molten metal into the casting space; and selective cooling means for selectively cooling said mold liner assembly in such a manner that cooling is directed in varying intensities to different portions of the inner surface of the mold liner assembly, and wherein said selective cooling means is constructed and arranged to direct diminished cooling to said central region.

7. An assembly according to claim 6, wherein said selective cooling means is constructed and arranged to direct cooling at varying intensities by accordingly varying the length of deepened slot portions according to the amount of cooling that is desired at a particular area in the moldface.

8. A method of operating a continuous casting machine of the type having a funnel-type mold liner assembly that has an inner surface defining a casting space in which molten metal may be shaped and cooled the inner surface defining a relatively wide central region, relatively narrow end regions, and transition regions between said central region and said end regions, comprising steps of:

(a) introducing molten metal into the casting space; and (b) selectively cooling the mold liner assembly in varying intensities at different portions of the inner surface of the mold liner assembly by directing enhanced cooling to said transition regions, whereby heat transfer inequality as a result of convection may be accommodated over the inner surface of the mold liner assembly, product quality is enhanced and mold life is lengthened.

9. A method according to claim 8, further comprising providing enhanced cooling to a portion of the inner surface of the mold liner assembly that corresponds to where the meniscus of the molten metal will be positioned during casting.

10. A method according to claim 8, wherein step (b) is performed by varying distances between the inner surface of the mold liner assembly and the bottoms of cooling slots that are defined in the mold liner assembly.

11. A method according to claim 10, wherein step (b) is further performed by varying the length of a deepened cooling slot according to the amount of additional cooling that is desired to be directed to an area of the mold liner assembly.

12. A method according to claim 8, wherein step (b) is performed by varying the length of a deepened cooling slot according to the amount of additional cooling that is desired to be directed to an area of the mold liner assembly.

13. A method according to claim 8, further comprising a step of, before step (b), predicting circulation patterns in the molten metal, and wherein step (b) is performed so as to selectively cool the mold liner assembly in varying intensities at different portions of the inner surface of the mold liner assembly according to said predicted circulation patterns in the molten metal.

14. A method of operating a continuous casting machine of the type having a funnel-type mold liner assembly that has an inner surface defining a casting space in which molten metal may be shaped and cooled the inner surface defining a relatively wide central region, relatively narrow end regions, and transition regions between said central region and said end regions, comprising steps of:

(a) introducing molten metal into the casting space; and (b) selectively cooling the mold liner assembly in varying intensities at different portions of the inner surface of the mold liner assembly by directing diminished cooling to said central region, whereby heat transfer inequality as a result of convection may be accommodated over the inner surface of the mold liner assembly, product quality is enhanced and mold life is lengthened.

15. A method according to claim 14, wherein step (b) is performed by varying the length of a deepened cooling slot according to the amount of additional cooling that is desired to be directed to an area of the mold liner assembly.

* * * * *

UNITED STATES PATENT AND TRADEMARK OFFICE

CERTIFICATE OF CORRECTION

PATENT NO. : 5,927,378

DATED : July 27, 1999

INVENTOR(S) : Grove, et al.

It is certified that error appears in the above-identified patent and that said Letters Patent are hereby corrected as shown below:

Page 1, line 39 change "contribute" to - - contributes - -.
Page 1, line 51 change "cause" to - - causes - -.
Page 4, line 37, change "Td[<m]ditl-Tm" to - - Tb - Tm - -.

Signed and Sealed this

Eighth Day of May, 2001

*Attest:*

Nicholas P. Godici

NICHOLAS P. GODICI

*Attesting Officer*

*Acting Director of the United States Patent and Trademark Office*